US006347533B1

(12) United States Patent
Tung

(10) Patent No.: US 6,347,533 B1
(45) Date of Patent: Feb. 19, 2002

(54) HYDRAULICALLY BALANCED FULLY THERMALLY COUPLED SYSTEM

(76) Inventor: Peter Tung, 63 Templer Dr., Ancaster (CA), L96 3X7

( * ) Notice: Subject to any disclaimer, the term of this patent is extended or adjusted under 35 U.S.C. 154(b) by 0 days.

(21) Appl. No.: 09/518,530

(22) Filed: Mar. 4, 2000

(51) Int. Cl.[7] ..... F25J 3/00; F25J 5/00

(52) U.S. Cl. ..... 62/620; 62/643; 62/631; 62/905

(58) Field of Search ..... 62/617, 643, 630, 62/905, 631, 620

(56) References Cited

U.S. PATENT DOCUMENTS 1,549,236 A * 8/1925 Van Nuys ..... 62/617
1,782,287 A * 11/1930 Claude ..... 62/643
1,885,059 A * 10/1932 Cicali ..... 62/617
5,339,648 A * 8/1994 Lockett et al. ..... 62/646
5,970,742 A * 10/1999 Agrawal et al. ..... 62/630
6,106,674 A * 8/2000 Agrawal et al. ..... 203/75

* cited by examiner

*Primary Examiner*—William C. Doerrler

(57) ABSTRACT

A fully thermally coupled distillation structure designed to overcome hydraulic limitations in the past has been revealed for separating a multi-component feed stream into three product streams. The fractionation apparatus is equipped with at least one condenser and one reboiler to provide fractionation efficiency surpassing the PETLYUK system. Further, the fractionation apparatus includes innovative designs to enable hydraulically balanced and energy efficient operation at various feed rates, compositions and product specifications.

20 Claims, 7 Drawing Sheets

LC
PC
SIDE DRAW
FEED
BTM

LC
PC
FEED 2
FEED 1
BTM 2
BTM 1

200
66
30
12
DIST
31
99
ZONE D
7
32
64
65
33
70
99
34
13
ZONE S
5
SIDE DRAW
35
D
99
90
FEED
63
11
ZONE F
3
80
62
61
36
99
99
ZONE B
1
60
100
14
BTM 200
66
30
12
31
DIST
99
ZONE D
7
64
32
34
33
70
99
11
65
FEED
ZONE F
3
62
99
90
36
ZONE S
13
SIDE DRAW
5
80
63
61
35
99
99
ZONE B
1
60
100
14
BTM

HYDRAULICALLY BALANCED FULLY THERMALLY COUPLED SYSTEM

BACKGROUND—FIELD OF THE INVENTION

This invention relates to a fractionation column and method of operation thereof. In a specific respect, the invention relates to separating at least one feed stream containing at least two components, into at least one overhead distillate stream, at least one side draw stream and at least one bottom stream, each such product stream containing different averaged volatility than the other product streams. The fractionation column is equipped with at least one condenser and at least one reboiler. Further, the fractionation apparatus includes innovative designs to enable hydraulically balanced and energy efficient operation at various feed rates, compositions and product specifications.

BACKGROUND—DISCUSSION OF PRIOR ART

In fractionation, it is sometimes desirable to separate a multi-component feed stream into a number of streams containing various fractions of desirable components in the product streams. For the case of one feed stream and two product streams, the separation can be accomplished by distillate and bottoms product draw. Further separation can be accomplished by repeating the two-product stream process to either the distillate or the bottoms streams. However, the introduction of additional columns will require a corresponding number of reboilers and condensers. That requirement, in turn, requires additional operating costs as the condensing and the reboiling process is being repeated. Numerous references can be found in prior art documenting efforts to lower both capital and operating costs in the above-mentioned separation. The benchmark of the lowest energy consumption has been set by the well-known PETLYUK system as shown in FIG. 1.

In this configuration, a prefractionation column separates the feed into two streams using a split vapor stream from the main column's stripping section and a split liquid stream from the main column's rectifying section. The resulting vapor and liquid streams exiting from the prefractionation column is richer in light and heavy components respectively. These two semi-processed streams are then fed back to the main column. This configuration provides an advantage allowing the main fractionation column to enhance the purity of the side stream draw. In turn, the main fractionation column also provides the stripping section and the rectifying section with better quality feeds. The combined effect is a very efficient use of vapor/liquid traffic to yield three product streams. The drawback from such an ingenious design is that the vapor and liquid streams at the communicating crossovers are almost at the same operating pressures, making the column next to impossible to operate. Consequently, not one such design has ever been operated commercially.

Wright in U.S. Pat No. 2,471,134 proposed to combine the prefractionation and main columns into one fractionation unit by erecting a partition along the center part of a column. The column is equipped with one overhead condenser and one bottom reboiler. This prior art is shown in FIG. 2. This setup is effective in overcoming the hydraulic limitations in the PETLYUK system. At the same time, it reduces capital costs by having only one common shell. However, the fixed internals offers no adjustments in vapor/liquid traffic in either side of the partition. As feed quality and rate changes, the desired operating range could very easily fall outside of the original design envelope.

In U.S. Pat No. 3,053,521 Plaster and Dixon taught the use of introducing a tray in a column having a large cross sectional area. The level of the stored liquid in the tray affects the rate of internal liquid flow through a perforated weir. Resetting a side draw flow controller controls the level in the tray. That effectively controls the internal liquid traffic in the column.

Graven taught the use of a partitioned stripping section as shown in FIG. 3 using two reboilers on either side of the partition in U.S. Pat No. 3,412,016. This configuration handles two feeds with different quality of higher boiler contents and economizes by sharing a common rectifying section. Two bottoms product streams and one distillate product stream result from such a configuration.

In U.S. Pat No. 4,230,533, as shown in FIG. 4, Giroux taught the use of a method to adjust vapor and liquid traffic in a divided wall column that was described by Wright earlier. The proposed column internals and additional control loops were designed to provide control of liquid and vapor traffic in the two sides of the internal partition. Unlike Wright's design, which has fixed internal arrangement, Giroux's proposal claimed to be able to handle changes in feed rate, quality and product specifications. The very concept of a divided wall column configuration has one obvious intrinsic limitation. By sharing a partition, the stages available for prefractionation and main fractionation is tied. In other words, the ratio of stages between feed side and product side cannot deviate too far away from unity. Some design scenarios, however, may be more effective if that ratio is allowed to be higher or lower than unity.

Two other U.S. Patents also made reference to the PETYLUK benchmark. They are described as follows:

U.S. Pat No. 5,755,933 assigned to M.W. Kellogg Company of Houston Tex. taught the use of a partitioned rectification section, each having its condenser in the overhead as shown in FIG. 5. The lightest product stream is to be collected as distillate on the feed side of the partition. The intermediate product stream is to be collected as the distillate from the other overhead condenser. The heaviest product is to be recovered as the bottoms. This design offers a unique benefit as the vapor flow is directly affected by the corresponding condenser duty. Increasing the condensing duty in either one of the overhead condensers causes a local vapor inventory decrease as vapor is condensed to form liquid. The corresponding lower pressure at the top will cause higher flow of vapor flowing upwards. As well, the reflux can be increased to effect higher liquid/vapor traffic. However, there are a few drawbacks in this proposed configuration.

1) A vaporized feed is highly recommended in order to prevent the light products from passing under the partition. Should that be allowed to happen, the intermediate component will be irreversibly contaminated with the light products.
2) The partition gives the two rectifying sections roughly the same number of stages. That requirement, again, may not be the most desirable design.
3) An additional condenser is required.

U.S. Pat No. 5,970,742 assigned to Air Products and Chemicals Inc. of Allentown Penn. taught the use of a "modified" PETLYUK system. In this design, liquid and vapor is being generated in the prefractionation column by adding a condenser or a reboiler respectively as shown in FIG. 6. The Patent claims to be almost as energy efficient as the PETLYUK system. A simple analysis would arrive at quite a different conclusion. Let us consider the prefractionation condenser in this configuration. Since this secondary reflux is generated by the secondary condenser, which is situated at a point below the main condenser, the secondary reflux is effectively bypassing the top section of the main column. Similarly, the reboiler duty used in the prefractionation column is again effectively bypassing the bottom stripping section of the main column. Therefore, thermodynamically, this configuration can never be as efficient as the PETLYUK system. The departure from the benchmark in the condenser configuration depends on the relative volatility between the lightest product and the intermediate product as well as the stages above the vapor return to the main column. In effect, how much fractionation the internal reflux bypassing is giving up. Similarly, the departure from the benchmark in the reboiler configuration depends on the relative volatility between the intermediate product and the heavy product and the stages below the liquid return to the main column. In effect, how much fractionation the vapor bypassing is giving up. Obviously, an additional heat exchanger is required in this configuration. Not so obvious is the hydraulic difficulty in the condenser scenario. Unlike the Kellogg arrangement where the condenser can vary its duties at will and create vapor traffic as a result of condensing vapor, this prior art faces competing vapors from both columns. This poses further operating difficulty in varying the secondary condenser duty.

As can be seen from the prior art cited above, a truly fully thermally coupled column has yet to be reduced to practice. Another area of improvement needs to be addressed from a thermodynamic efficiency perspective. In the shared rectification section of the two columns, the vapor streams from the two columns could contain very different qualities of vapor. The same reasoning applies to the liquids entering the shared stripping section. Should these streams be mixed?

A hydraulically balanced and thermodynamically efficient fully thermally coupled column has yet to emerge.

OBJECTS AND ADVANTAGES

Accordingly, several objects and advantages of this invention are:

The present invention focuses on overcoming the difficulties in making a fully thermally coupled column hydraulically operable and capturing the thermodynamic efficiency that such system could provide.

The present invention takes the approach of built-in design flexibility so that the resulting apparatus and control method can cover a wide range of operating scenarios.

It is another object of this invention to challenge the benchmark set by the PETLYUK system and to find ways to achieve a even higher thermodynamic efficiency than was previously thought to be the practical limitation.

It is another object of this invention to further improve the efficiency of a divided wall column by further analysis of the mixing zones in the column.

It is yet another object of the invention to generalize the system for use in a two component system separation.

It is yet another objective of this invention to illustrate the method and opportunity of applying this invention to retrofitting existing columns.

It is yet another objective of this invention to enable reactive distillation to be carried out in a more confined process environment to further improve reaction selectivity.

Further objects and advantages of this invention will become apparent from a consideration of drawings and ensuing description.

SUMMARY

Figure 2:
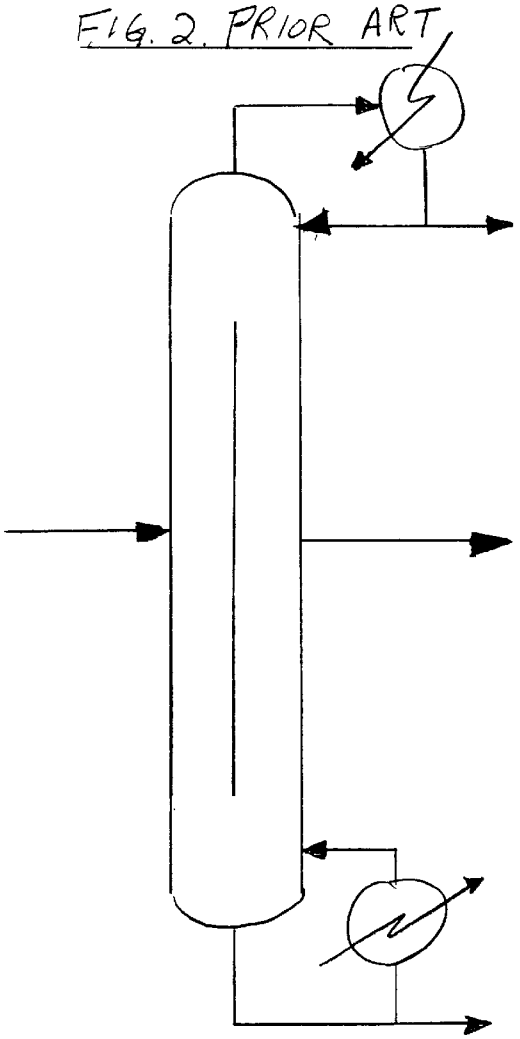
FIG. 2. PRIOR ART
FIG. 2 shows Wright's divided wall column.
Figure 1:
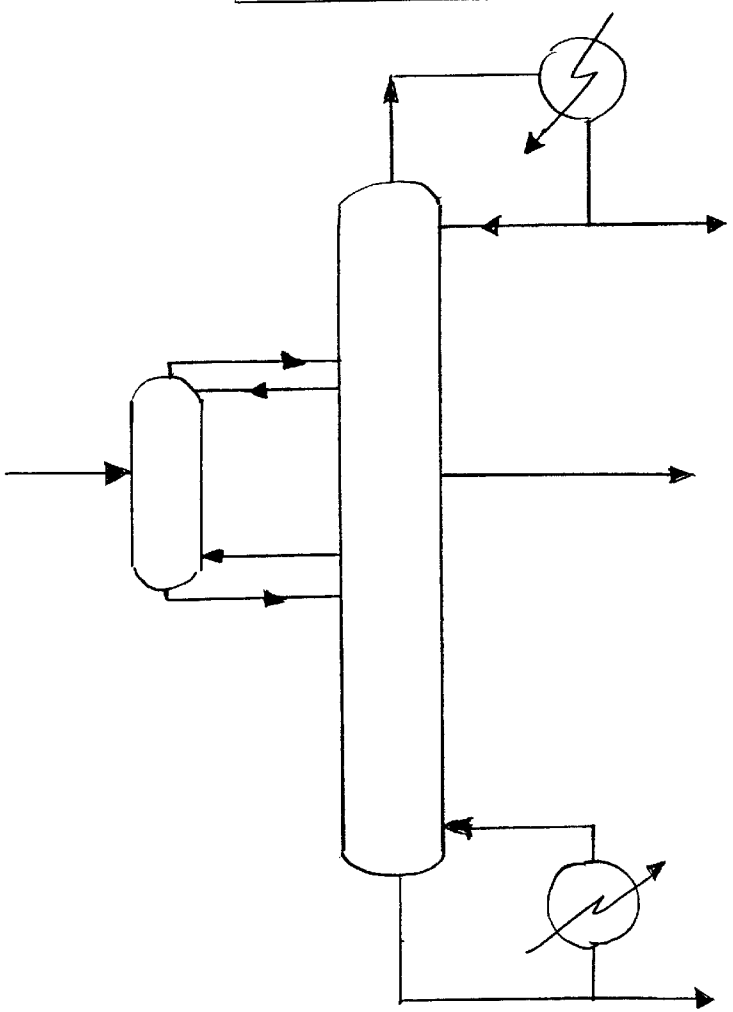
FIG. 1 PRIOR ART
FIG. 1 shows the well-known benchmark PETLYUK system.
Figure 4:
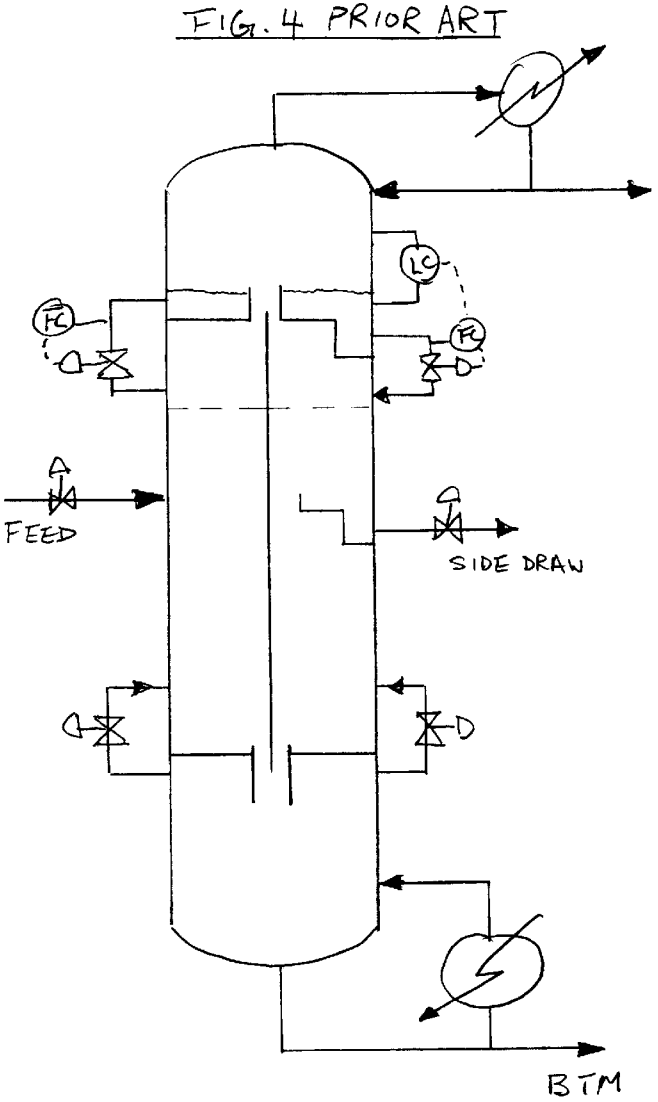
FIG. 4 PRIOR ART
FIG. 4 shows Giroux's divided wall column with vapor and liquid control loops.
Figure 3:
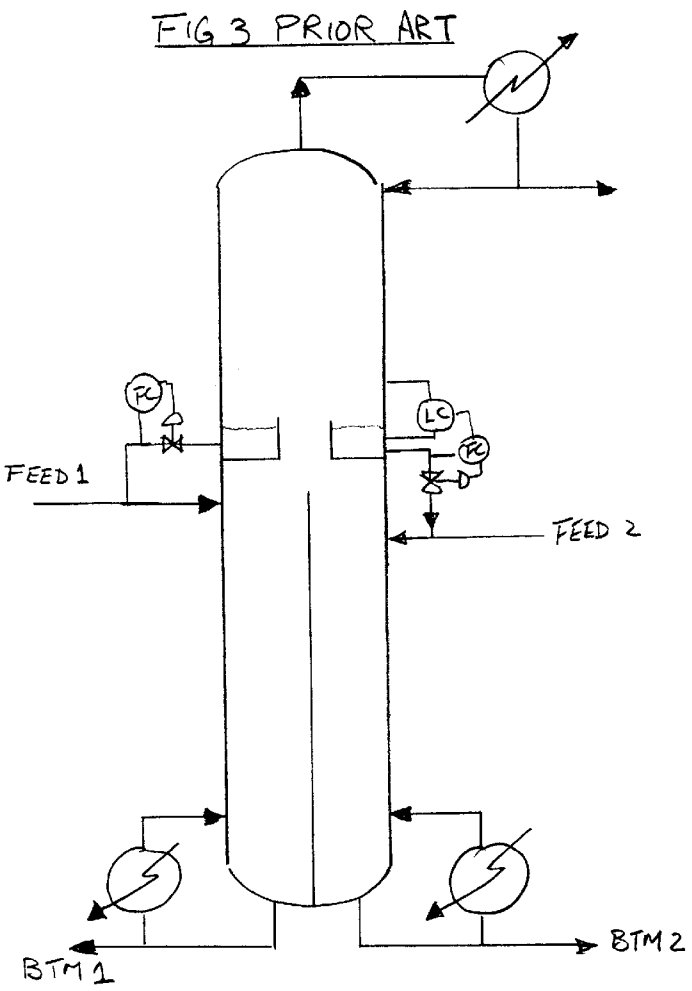
FIG 3 PRIOR ART
FIG. 3 shows Graven's two reboilers and one condenser divided wall column.
Figure 5:
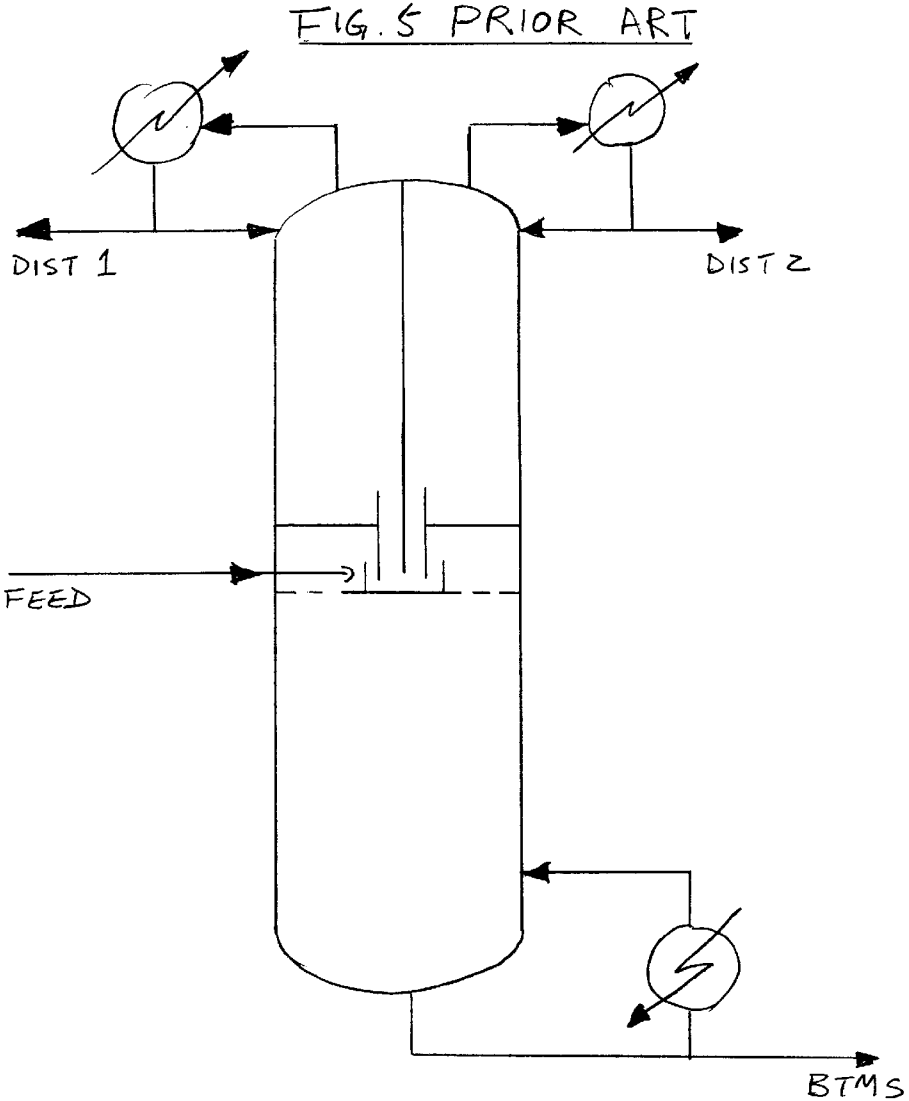
FIG. 5 PRIOR ART
FIG. 5 shows Kellogg's two condensers and one reboiler divided wall column.
Figure 6:
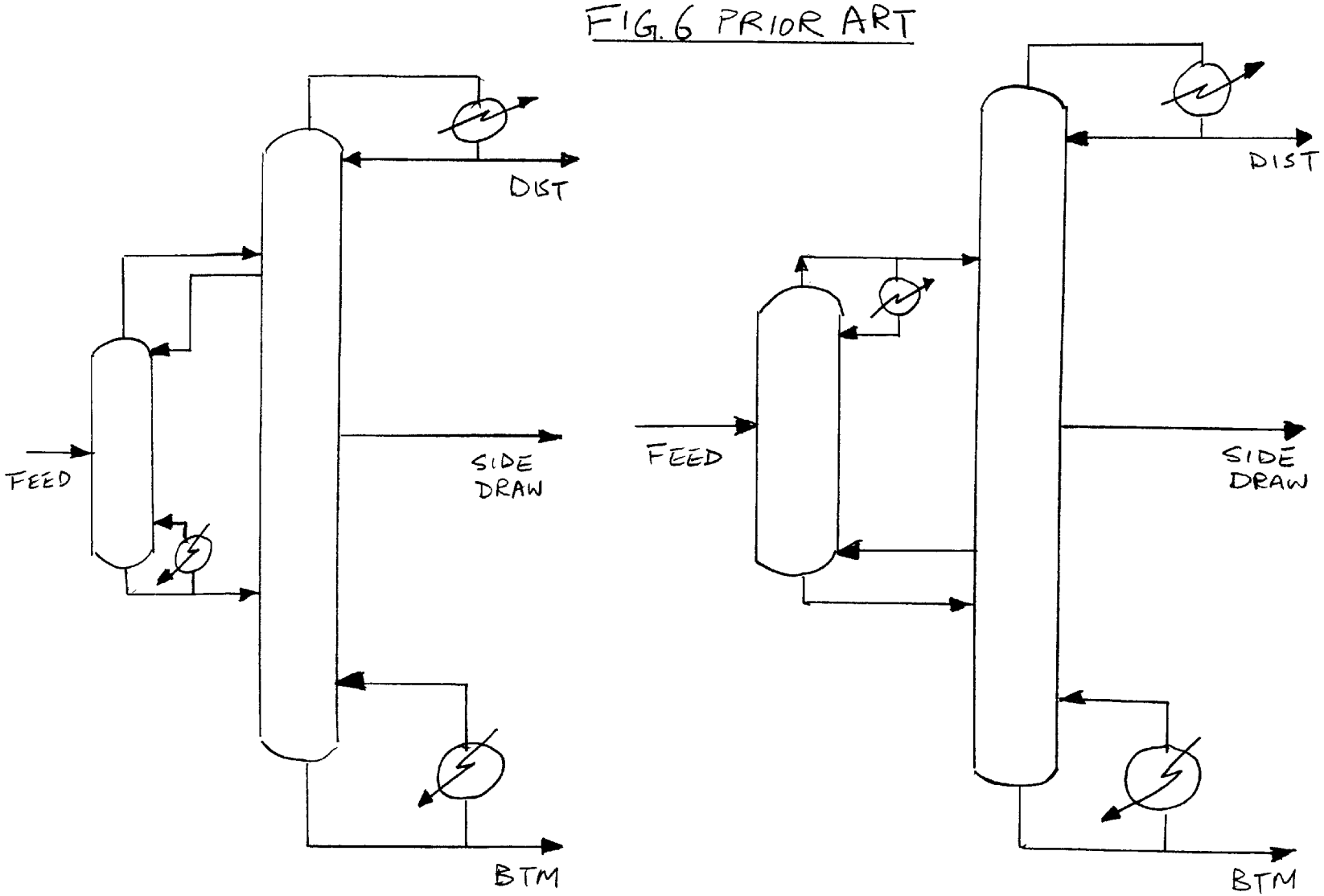
FIG. 6 PRIOR ART
FIG. 6 shows Air Product's modified PETLYUK column.

The summary of this invention is an apparatus and corresponding control method to separate a feed stream containing at least two different boiling point components into three product streams. The apparatus used is hydraulically balanced and fully thermally coupled. The apparatus comprised of one common stripping section, one prefractionation section, one main fractionation section and one common rectification section. The column is equipped with at least one reboiler and at least one condenser. All sections can be designed to have different number of stages while preferably sharing the same diameter, though not a requirement. The internal and external connections, control valves and special arrangements are designed to provide the controllability of the column over a wide range of operating conditions. This invention matches, or even surpasses, the level of energy efficiency as benchmarked by the PETLYUK system.

DESCRIPTION OF THE INVENTION

This invention relates to a separation apparatus that takes a multi-component feed stream containing at least two key components targeted for separation. The feed stream is fractionated into three product streams, each containing different fractions of components resulting in different average boiling points or averaged volatility. It is to be understood that the scope of the present invention is not to be limited by the following examples. They are merely for further clarification purpose.

One petrochemical example is to separate a 60/40 mixture of ethylene and ethane (only two components) stream into three product streams. One light stream has an ethylene specification of 99.5% purity, a typical polymer grade. The heavy stream has an ethane specification of say 95% for recycle to cracking heaters, and the intermediate dilute ethylene stream targeting for a 75% ethylene content for special polymerization reactions.

Another example in an oil refinery scenario could be to separate a hydrofined feed stock into three product streams with different boiling point ranges. The feed has a 5% boiling point of say 200 degrees F. and a 95% boiling point of 400 degrees F. and covers a wide spectrum of components.

The later example illustrates that the scheme shows the particular component, or components, which the respective product stream is enriched in, but does not necessarily mean the absence of other components in that product stream. This invention is tailored to perform the required separation with efficient use of energy, ease of operation and low capital costs. Before describing the invention in detail, analysis of relevant prior art will aid in the understanding of the concepts of this invention.

Background

It is commonly accepted that the PETLYUK system is the most efficient system in separating a feed stream into three product streams. The reason behind this high efficiency is the fully thermally coupled configuration. This configuration allows efficient use of vapor, generated from the only reboiler, and liquid, generated from the only condenser, to run the full course of the stages provided for vapor/liquid contact. Therefore, for a given number of stages, feed composition, product specification and operating pressure, the PETLYUK system requires the least amount of reboiler duty.

A close match is Wright's proposal, using a divided wall column to mechanically preset the vapor/liquid splits in the parallel system. This setup inevitably surrenders the flexibility of making adjustments to handle future feed quality, rate and product specification changes. In other words, Wright's system could achieve the PETLYUK efficiency for a particular feed condition if designed properly, but may not be possible at other operating conditions. The rate of heat transfer across the partition adds to the confusion as well.

In U.S. Pat No. 4,230,533, Giroux recognized the above built-in limitation on operational flexibility and proposed an internal liquid/vapor control mechanism for a divided wall column. It is an admirable attempt using state of the art control techniques at the time. However, the operating range and stability is still quite limited. It is of high relevance to analyze the cause of limitations before the full impact of the present invention can be appreciated.

For this reason, a detailed hydraulic analysis of Giroux's design is discussed below.

For the splitting of liquid flow without using a pump as proposed:

It is a major challenge to control the internal liquid split between the two partitioned sections using only hydrostatic head. Hydrostatic head available is the elevation between the liquid level at the reservoir above and the liquid level at the tray below. In theory, there is no limit on the available head. In practice, however, the non-productive column height could be filled with mass transfer media and better utilized to provide additional separation. Furthermore, flow varies with the square root of pressure difference. It would follow that for a given maximum available hydrostatic head, the control valve would soon be limited and cannot provide an effective control range.

Splitting vapor flow is even more challenging because excessive pressure drop would cause Downcommer backup unless very tall Downcommers are used.

To further illustrate this very important point, let us consider the vapor passage across a trayed column. The pressure drop across a tray, at a given vapor flow rate, is a function of the resistance across the active area on the tray. The column, for pressure drop consideration, is essentially a series of orifice plates. Some control application has inferred vapor flow across the column by the measured pressure drop across the column, square rooted. This reasoning is also applicable to other mass transfer apparatus such as packing. Again, the question is how much height in a column can be sacrificed in order to give a reasonable vapor flow control range.

Clearly, Giroux's proposal still cannot provide the much-needed operating flexibility that has been identified for quite some time. The present invention focuses on overcoming the limitations in prior art and proposes a hydraulically balanced system. Before going into details of such a novel invention, another thermodynamic point may not have been previously explored due to the hydraulic balance hurdle. Thermodynamic analysis of the PETLYUK system particularly the vapor mixing and liquid mixing zones is as follows:

Let us focus on the vapor/liquid traffic at the top of the partition of a divided wall column, FIG. 2, (special application of the PETLYUK system) as an illustration. At the top end of the partition, the two streams of vapor from both sides of the partition emerge. The vapor from the prefractionation side, feed side, can be regarded as the primary feed to the rectifying section while the vapor from the main fractionation side, the side draw product side, as the secondary feed. The above is taken as a convention, with no reflection on stream quality. The quality of the respective streams depends on the degree of separation and the respective composition profile across the two columns. For instance, if the main column has a higher vapor liquid traffic than the prefractionation column to effect a finer separation, and the requirement of the intermediate product stream results in high light product content entering into the rectifying section, then the secondary vapor stream is already better rectified than the corresponding vapor from the other side of the partition. It would be thermodynamically unwise to mix dissimilar streams together. A more efficient way would be to return the better stream to a higher location in the rectifying section.

The same reasoning can be applied towards the two liquid streams returning to the shared stripping section. Again, depending on operating condition, one of the streams could very well be better enriched with the heavy component than the other stream. Proper placement of the streams would give even better thermodynamic efficiency than suggested by the PETLYUK system. Therefore, based on the above thermodynamic efficiency consideration, the opportunity to challenge the benchmarked PETLYUK system exists. This additional focus will be explained in further details.

Present Invention

Figure 7:
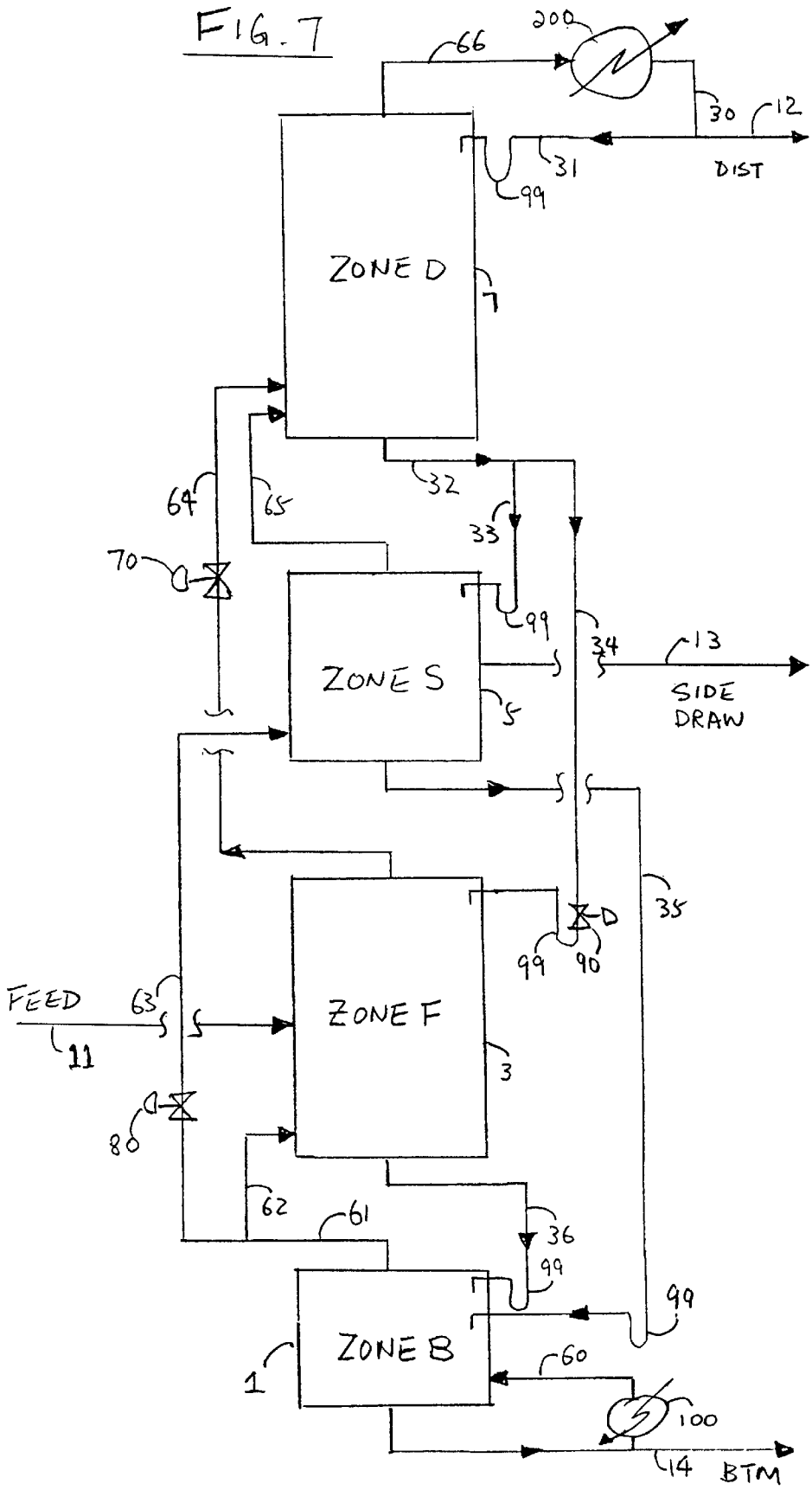
FIG. 7 shows a typical HBFTC system.

Let us examine the configuration as in FIG. 7 for illustration purpose. This arrangement, defined as one expression of a Hydraulically Balanced Fully Thermally Coupled system (HBFTC system), is a column equipped with one reboiler 100 and one condenser 200. Further, the column is divided into four operating zones, in ascending elevation as follows:

A stripping zone, zone B, 1 the bottoms product zone.

A prefractionation zone, zone F, 3 the feed zone.

A main fractionation zone, zone S, 5 the side stream draw off zone.

A rectifying zone, zone D, 7 the distillate product zone.

Figure 8:
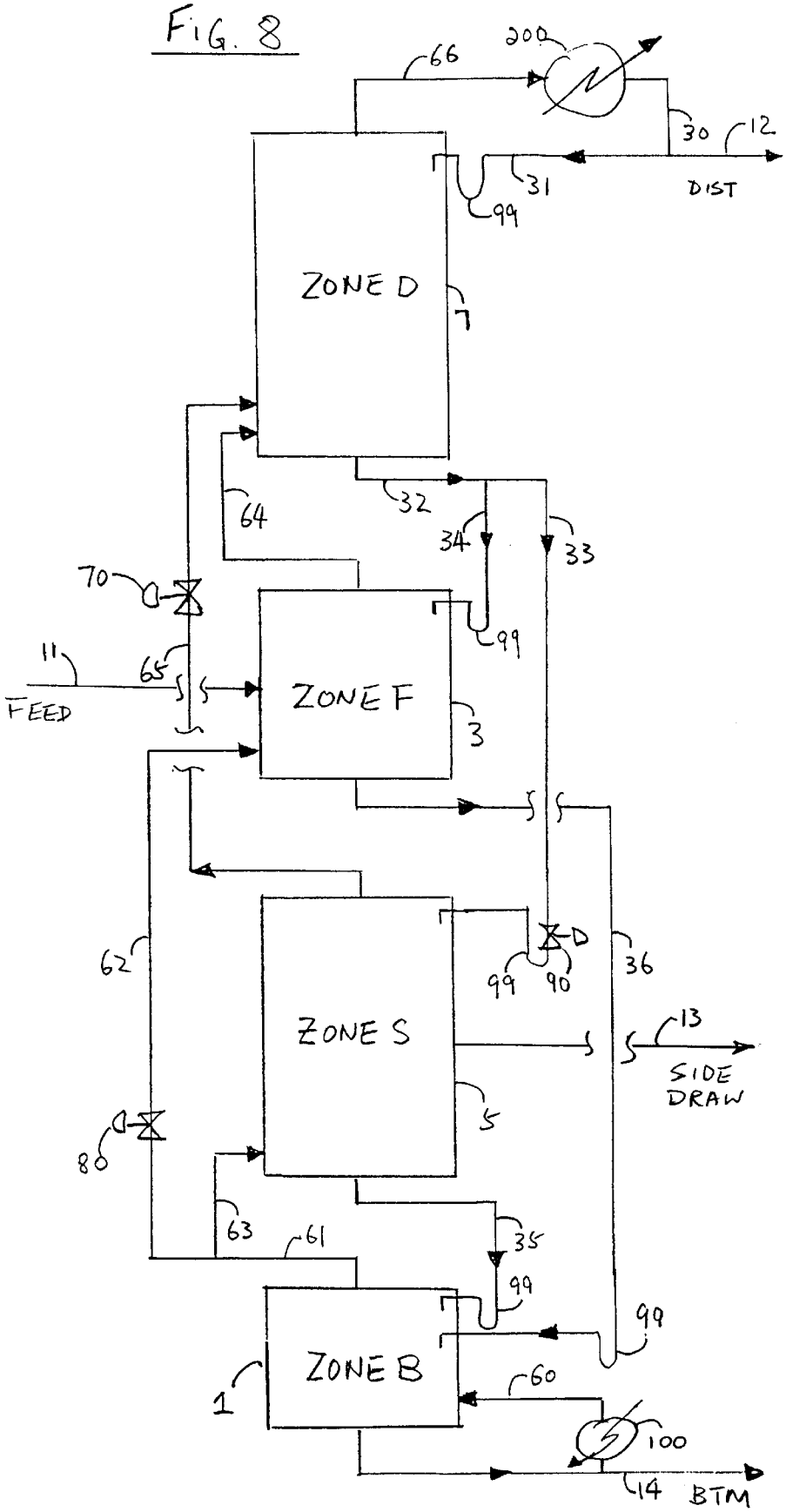
FIG. 8 shows one alternate arrangement of a HBFTC system.

By interchanging the position of S 5 and F 3, an alternate arrangement is shown in FIG. 8. The following is stream descriptions of each zone, interestingly enough, applies to both FIG. 7 and FIG. 8:

Prefractionation Zone, Zone F 3

A feed stream 11 enters zone F 3 and is separated into two streams, one liquid stream 36 rich in the heavy component and a vapor stream 64 that is rich in the light component. The separation is effected by two streams, one liquid and one vapor. The liquid stream 34, containing both light and intermediate components, enters zone F 3 from the rectifying zone, zone D 7. Another stream 62, which is a vapor stream, enters zone F 3 from the stripping zone, zone B 1 contains both intermediate and heavy components.

Stripping Zone, Zone B 1

Liquid 36 from zone F 3 and liquid 35 from zone S 5, both containing intermediate and heavy components enters zone B 1 at the upper section. Vapor 60 generated from the reboiler 100 in zone B 1 causes the separation of intermediate component from the heavy component. The resulting stripped liquid is routed away as the bottoms product stream 14. The vapor stream 61 leaving zone B 1, which contains intermediate and heavy components is split into two separate streams, one stream 62 is routed to the prefractionation zone,zone F 3 and the other stream 63 enters the main fractionation zone,zone S 5. The quantity of each vapor flow from zone B 1 is rationed. The method of rationing and the resulting effect will be discussed in further details later.

Rectifying Zone, Zone D 7

Vapor 64 from zone F 3 and vapor 65 from zone S 5, both containing intermediate and heavy components enters zone D 7 at the lower section. Liquid 30 generated from the condenser 200 enters zone D 7 at the top, causes the separation of light component from the intermediate component. The resulting rectified vapor 66 is condensed 30 and routed away as the distillate product stream 12. The internal reflux 31 also generates a liquid stream. This liquid stream 32 leaving zone D 7, which contains light and intermediate components is split into two separate streams, one stream 33 is routed to the main fractionation zone, zone S 5 below and the other stream 34 enters zone F 3 below. Like the vapors 62 and 63 from zone B 1, the quantity of each liquid flow 33 and 34 from zone D 7 is also rationed. The method of rationing and the resulting effect will be discussed in further details later.

Main Fractionation Zone, Zone S 5

Vapor 63 from zone B 1 enters this zone,zone S 5 from the bottom. Liquid 33 from zone D 7 enters from the top. The resulting fractionation generates a vapor stream 65 and a liquid stream 35 plus a side draw 13 that contains the predominant intermediate component. The vapor stream 65 exits the top and enters zone D 7 at the lower section while the liquid 35 exits the bottom and enters zone B 1 at an upper section.

The above completes the routing of one HBTFC system.

One of the many special features in this invention is the unparalleled ability to hydraulically balance the vapor and liquid flows across all the zones and maintain operating flexibility. The following is a step by step analysis of all the communicated zones and the method of achieving hydraulic balance.

Hydraulic Analysis of Vapor Communication Loops as Shown in FIG. 7

Zone D 7 and zone S 5 can communicate freely and so can zone F 3 and zone B 1. The vapor lines between the two respective zones are acting like balance lines allowing liquid to flow down freely. Self-venting liquid lines can further eliminate the need for the vapor line piping requirement. Now let us focus on the overall vapor flow pattern across the column.

Vapor 61 exiting zone B 1 is to be split between two routes,

From B 1 via 63 through S 5 via 65 to D 7, the first path or From B 1 via 62 through F 3 via 64 to D 7, the second path Hydraulically, the relative resistances between the above two routes effect the actual vapor flow rates. If vapor-rationing target is to be maintained, relative resistances between the two parallel vapor paths have to be manipulated. That can be accomplished by adjusting the relative resistance by either:

Using manual valve 80 to adjust vapor flow resistance across the first path, or Using control valve 70 to adjust vapor flow resistance across the second path, or Using both valves 70 and 80 combined, depending on design criteria of F 3 and D 5.

Unlike prior art attempts, these two loops provide very wide operating ranges. The maximum available pressure drop range is being supplied by the corresponding liquid heads across the entire zones of F 3 and S 5 for valves 80 and 70 respectively as shown in FIG. 7. As manual valve 80 starts to impose an added restriction across the vapor communication line between zone B 1 and zone S 5, liquid head in line 35 communicating between zone S 5 and zone B 1 will rise to reflect the pressure difference. Therefore, the control range is almost the full height of the elevation differences. To put the pressure drop available for control into perspective, a minimum of 10 psi can be easily made available for a typical column. For those who are familiar in the art of designing thermosiphon reboilers for fractionation columns, the reasoning and design criteria should now be very clear. The same reasoning applies towards the hydraulic control and balance between zone F 3 and zone D 7 with one added variation. The liquid flow 32 from zone D 7 has to be divided between 34 and 33 going to zone F 3 and zone S 5 respectively. The following description of the liquid loops will make clear the above statement also.

Figure 9:
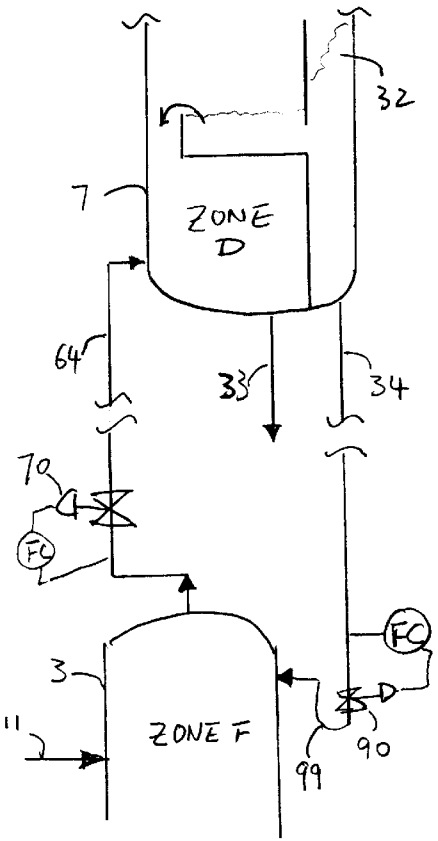
FIG. 9 shows column internals for rationing internal liquid flow.

FIG. 9 shows the details of the column internals around the zone D 7 liquid outlet flow 32. Liquid flow control from zone D 7 to zone F 3 as shown in FIG. 7 is effected by control valve 90. The control valve 90 is preferably located towards the lower end of the liquid leg as shown to prevent flashing on the downstream side of the control valve 90. That location also ensures that the leg is flooded at all times to give reliable liquid flow control. From the detail drawing, it is shown that the liquid 32 has to first satisfy the flow requirement 34 from flow control valve 90 and any surplus 33 will be cascaded to the next level towards zone S 3. This internal weir structure 95 eliminates the use of an additional level control loop. Liquid seal loops 99 are recommended at all liquid re-entry points to the column.

At this point, those who are familiar in the art of distillation and control should feel comfortable that the problem of flow control based on column hydraulics has been positively identified, analyzed and resolved. Furthermore, other arrangements of the above operating zones will be apparent to persons skilled in the art. Methods such as with the aid of pumps or fluid density modifying means would allow same or different elevations of the various zones, without departure from the spirit and scope of this invention. The next challenge is to take further advantage of concentration differences that would enable a even more efficient separation process.

The PETLYUK system requires that the two points of entry to and from the two columns be at the same elevation in order to avoid hydraulic imbalance. However, it may be advantageous, processwise, to return the vapor at a lower position and the liquid at a higher location due to the quality of the returning streams. PETLYUK system does not provide that flexibility unless pumps are introduced. Even so, vapor flow control would still be a very challenging task.

This invention, in contrast, provides unrestricted choice of re-entry locations, in terms of elevation, both for liquid streams entering the stripping zone as well as vapor streams entering the rectifying zone. The hydraulic limitation in the past has now been eliminated. Therefore, a more efficient separation system than previously thought possible as benchmarked by the PETLYUK system is now available. Proper process simulation can pin point the optimum vapor/liquid re-entry locations. By applying this concept to a divided wall column, the following improvements can also be realized.

Figure 10:
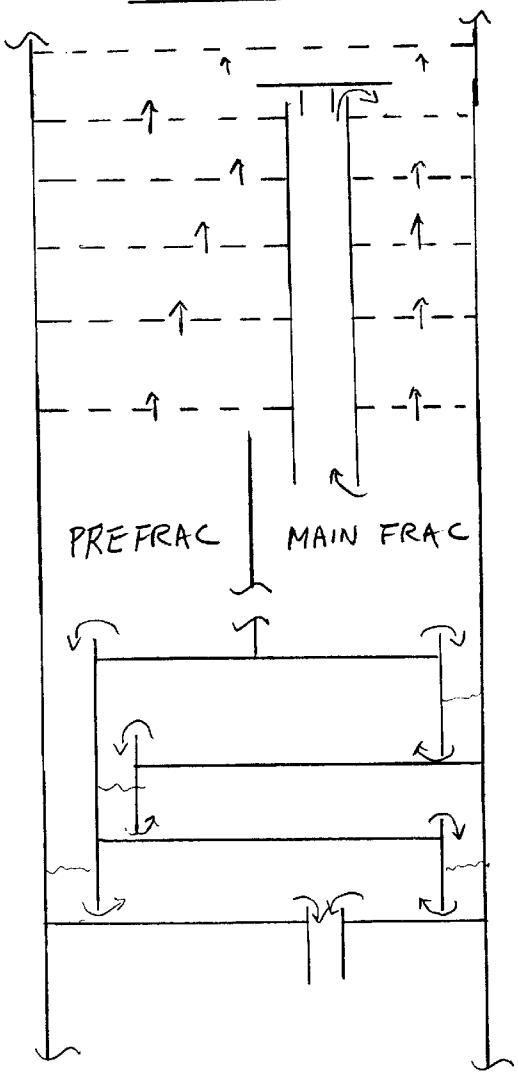
FIG. 10 shows column internals to improve divided wall column efficiencies.

Divided wall column as proposed by Wright and Giroux lack the flexibility in design to take advantage of the concentration difference. FIG. 10, within the spirit of this invention, shows the column internals that could overcome that limitation. Vapor from either side of the partition is allowed to bypass internally or externally to a higher location so that a suitable mixing location, which offers better thermodynamic efficiency, can be used. Similarly, liquid from either side of the partition can be allowed to bypass internally or externally to a lower location in the column. The vapor and liquid bypassing arrangement can be applied to any mass transfer media. External liquid bypass can be combined with arrangements shown in FIG. 9 on both sides of the partition to further increase operational flexibility by providing an on/off by-passing option.

One other built in flexibility needs to be mentioned as well. Unlike the divided wall column where the corresponding stages are essentially fixed, this invention imposes no such restriction. As much as the process designer wishes to optimize the relative separation capabilities between the prefractionation and the main column, this invention will not be hindering his or her effort. Dissimilar number of stages in the prefractionation zone and main fractionation zone offers great advantage in flexibility. A much wider separation scenarios can be covered without changing the hydraulic balance and control loop tuning set up by simply providing feed and side stream draw switching capability. That way, FIG. 7 can be switched over to FIG. 8 operation with a couple of valve swings. This invention is nothing other than truly remarkable.

Additional Ramifications

The concept of a HBFTC system as described can be extended to retrofiting existing units. Both the yield and the purity specification of a side draw stream can be enhanced by installing a partition across the middle part of an existing column. Suitable vapor and liquid internal and/or external can be provided to capture the otherwise lost thermodynamic efficiency due to mixing effect. On the other hand, a total conversion to a HBFTC system as described in this invention could also be a viable alternative, depending on economics. New columns can also be added at grade level depending on the circumstances.

This invention shows a efficient way of isolating a product cut. Each operating zone can then become a physical zone by itself, containing high product concentration. This provision opens yet another ideal avenue for reactive distillation, naturally. During the front-end design stage of any grassroots plant or debottlenecking projects, HBFTC systems can now be an important option to consider. Options that could make a sizable impact on the feasibility of the project is made available by this invention.

Conclusion, Ramifications, and Scope of Invention

Thus, the reader will see that this invention is truly one practical solution of transforming the well-known fully thermally coupled systems to a hydraulically balanced state; only an academic dream in the past. In essence, the present invention provides a practical and thermodynamically powerful alternative in the field of separation processes. While the above description contain many specificities, these should not be construed as limitations on the scope of the invention, but rather as exemplification on one preferred embodiment thereof. Many other variations are possible. Examples can be found in reactive distillation, coal tar distillation, biotechnology, cryogenic separations, pharmaceutical manufacturing processes and food and beverage applications and the list goes on.

What is claimed as the invention is:

1. A system comprising of:

An apparatus further comprising of:

1. at least one reboiler, at least one condenser, means for mass transfer in between said reboiler and said condenser,
2. means for communicating and means for rationing internal vapor traffic between desirous zones within said apparatus,
3. means for communicating and means for rationing internal liquid traffic between desirous zones within the apparatus,
4. means for placing at least one vapor stream at a suitable location within the apparatus to minimize mixing inefficiencies,
5. means for placing at least one liquid stream at a suitable location within the apparatus to minimize mixing inefficiencies, means for maintaining hydraulic balance at changing operating conditions and control of the apparatus thereof, to separate at least one feed stream containing at least two components, into at least one overhead distillate stream, at least one side draw stream and at least one bottom stream; each such said product stream contains different averaged volatility.

2. The apparatus according to claim 1, wherein said means for mass transfer is a trayed distillation column comprising of four discrete operating zones in ascending elevation, namely:

A stripping zone, zone B, where a bottoms product is withdrawn,

A prefractionation zone, zone F, where a feed stream is introduced,

A main fractionation zone, zone S, where a side stream product is withdrawn,

A rectifying zone, zone D, where a distillate product stream is withdrawn,

With means for communicating and means for rationing internal vapor traffic from said zone B through said zone F to said zone D, and between the zone B through the zone S to the zone D; placing the vapor streams at a suitable location within the apparatus to minimize mixing inefficiencies, With means for communicating and means for rationing internal liquid traffic between the zone D to the zone S to the zone B, and between the zone D to the zone F to the zone B, placing the liquid streams at a suitable location within the apparatus to minimize mixing inefficiencies, With means for maintaining hydraulic balance at changing operating conditions and control of the apparatus thereof.

3. The apparatus according to claim 2, wherein the means for communicating and means for rationing internal vapor traffic between the various zones is described as follows:

The stripping zone, zone B,

The zone B is communicated without restriction from the top of the zone B with the bottom of the zone F, one other vapor communication route enables the zone B to communicate, at the top of the zone B, with the zone S, at the bottom of zone B, through a secondary adjustable restriction means, The prefractionation zone, zone F, The zone F, from the top of zone F, is communicated with the zone D at a suitable location in the zone D, through a primary adjustable restriction means in between, The main fractionation zone, zone S, The top of zone S is communicated without restriction with the zone D at a suitable location.

4. The apparatus according to claim 2, wherein the means for communicating internal liquid traffic between the various zones is described as follows:

The rectifying zone, zone D,

The zone D is communicated from the bottom of the zone D, without restriction, with the top of the zone S. One other liquid communication route communicates the zone D from the bottom of the zone D with the zone F, at the top of the zone F, with an adjustable restriction means to effect means of liquid flow rationing control, The main fractionation zone, zone S, Liquid from the zone F, at the bottom of the zone F, is communicated without restriction with the zone B at a suitable location, The prefractionation zone, zone F, The zone F is communicated from the bottom of the zone F, without restriction, with the zone B at a suitable location, All liquid flow entrances described above are equipped with a liquid seal.

5. The apparatus according to claim 3, wherein said primary adjustable restriction means is an automatic flow control valve.

6. The apparatus according to claim 3, wherein said secondary adjustable restriction means is a manual butterfly valve.

7. The apparatus according to claim 4, wherein said adjustable restriction means is an automatic flow control valve.

8. The apparatus according to claim 4, wherein said means for liquid flow rationing control is comprised of 1) withdrawing one portion of a liquid stream from a column's internal liquid traffic preferably at a Downcommer location to satisfy flow requirement of said portion of said liquid stream, and 2), overflowing the liquid stream remaining across an internal weir to satisfy said rationing control.

9. A divided wall column, comprising of an internal longitudinal partition resulting in creating a prefractionation zone and a main fractionation zone, wherein an internal liquid flow, selected from one of the following groups consisting of a liquid stream exiting from said prefractionation zone and a liquid stream exiting from said main fractionation zone;

is provided with means for bypassing at least one tray below said partition.

10. The apparatus according to claim 9, wherein said means for bypassing at least one tray below the partition is provided by a Downcommer extending through at least one tray below the partition.

11. The apparatus according to claim 9, wherein said means for bypassing at least one tray below the partition is provided by totally drawing off liquid from a tray at the partition and redirecting said liquid to return to the column at least one tray below the partition.

12. A divided wall column, comprising of an internal longitudinal partition resulting in creating a prefractionation zone and a main fractionation zone, wherein an internal vapor flow, selected from one of the following groups consisting of, a vapor stream exiting from said prefractionation zone and a vapor stream exiting from said main fractionation zone;

is provided with means for bypassing at least one tray above said partition.

13. The apparatus according to claim 12, wherein said means for bypassing at least one tray above the partition is provided by a chimney tray extending through at least one tray above the partition.

14. The apparatus according to claim 12, wherein said means for bypassing at least one tray above the partition is provided by totally withdrawing said vapor from a tray at the partition and redirecting the vapor to return to the column at least one tray above the partition.

15. The apparatus according to claim 1, wherein said reboiler and said condenser are powered by a heat pump.

16. The apparatus according to claim 2, wherein at least one of the said zones B, F, D and S functions as a reactive distillation zone.

17. The apparatus according to claim 16, wherein at least one reactant feed stream is fed to said reactive distillation zone.

18. The apparatus according to claim 16, wherein at least one product feed stream is withdrawn from said reactive distillation zone.

19. The apparatus according to claim 2, wherein said means of mass transfer comprised of a combination of tray and packed bed.

20. The apparatus according to claim 19, wherein said means of mass transfer contains catalysts.

* * * * *